US009249485B2

(12) United States Patent
Valls

(10) Patent No.: US 9,249,485 B2
(45) Date of Patent: Feb. 2, 2016

(54) COLD WORK TOOL STEEL WITH OUTSTANDING WELDABILITY

(75) Inventor: Isaac Valls, Barcelona (ES)

(73) Assignee: Rovalma SA, Barcelona (ES)

( * ) Notice: Subject to any disclaimer, the term of this patent is extended or adjusted under 35 U.S.C. 154(b) by 1351 days.

(21) Appl. No.: 12/522,630

(22) PCT Filed: Jan. 11, 2008

(86) PCT No.: PCT/EP2008/050308

§ 371 (c)(1),
(2), (4) Date: Dec. 15, 2010

(87) PCT Pub. No.: WO2008/084108

PCT Pub. Date: Jul. 17, 2008

(65) Prior Publication Data

US 2011/0085930 A1 Apr. 14, 2011

(30) Foreign Application Priority Data

Jan. 12, 2007 (EP) ..... 07381003

(51) Int. Cl.

| | |
|---|---|
| ***C22C 38/40*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/40* (2013.01); *C22C 38/02* (2013.01); *C22C 38/04* (2013.01); *C22C 38/06* (2013.01)

(58) Field of Classification Search

CPC ..... C21D 2211/008

USPC ..... 148/320–328, 330, 332–337, 905; 420/8–12, 34, 36–39, 41–71, 77–81, 420/84–129

See application file for complete search history.

(56) References Cited

U.S. PATENT DOCUMENTS 2,715,576 A 8/1955 Payson et al.
3,619,179 A 11/1971 Malagari (Continued)

FOREIGN PATENT DOCUMENTS

EP 1 445 339 A 8/2004
FR 2 885 141 A 11/2006

(Continued)

OTHER PUBLICATIONS

"Tool Steels," ASM Handbook (Online), ASM International, 2002.*

(Continued)

*Primary Examiner* — Scott Kastler
*Assistant Examiner* — Vanessa Luk
(74) *Attorney, Agent, or Firm* — Ladas & Parry LLP

(57) ABSTRACT

A cold work tool steel with average or above wear resistance, a hardness in excess of (60) HRc and a very good toughness but with considerably lower carbon contents leading to highly improved weldability is obtained by combining the presence of primary carbides (or alternatively nitrides and/or borides) with other strengthening mechanisms like precipitation hardening or even solid solution. Vanadium rich MC type carbides, modified with refractory metal additions, present the best compromise of hardness and fracture toughness for several applications, while for other applications harder carbides, such as Ti carbides or Ti mixed carbides (primarily with V, Mo and/or W) will be the preferred ones, alternatively using Zr and Hf mixed carbides.

3 Claims, 1 Drawing Sheet

(56) References Cited

U.S. PATENT DOCUMENTS

| | | | | |
|---|---|---|---|---|
| 4,434,006 | A * | 2/1984 | Kato et al. | 420/11 |
| 5,989,490 | A | 11/1999 | Pinnow | |
| 6,663,726 | B2 * | 12/2003 | Abe et al. | 148/320 |
| 6,723,182 | B1 | 4/2004 | Bahmiller | |
| 7,445,750 | B1 * | 11/2008 | Beguinot et al. | 420/101 |

FOREIGN PATENT DOCUMENTS

| | | | | |
|---|---|---|---|---|
| FR | 2 887 558 | A | 12/2006 | |
| JP | 56-035752 | * | 4/1981 | C22C 38/28 |
| JP | 01 159353 | A | 6/1989 | |
| WO | 02/083966 | A | 10/2002 | |
| WO | WO 02/083966 | * | 10/2002 | C22C 38/22 |
| WO | 2006/114499 | A | 11/2006 | |

OTHER PUBLICATIONS

Full, professional (human) translation of JP 56-035752 to Hosomi et al., originally published on Apr. 8, 1981 in the Japanese language.*

Hardness Conversion for Steels, ASM Handbook, ASM International, 2003, 12 pages.*

* cited by examiner

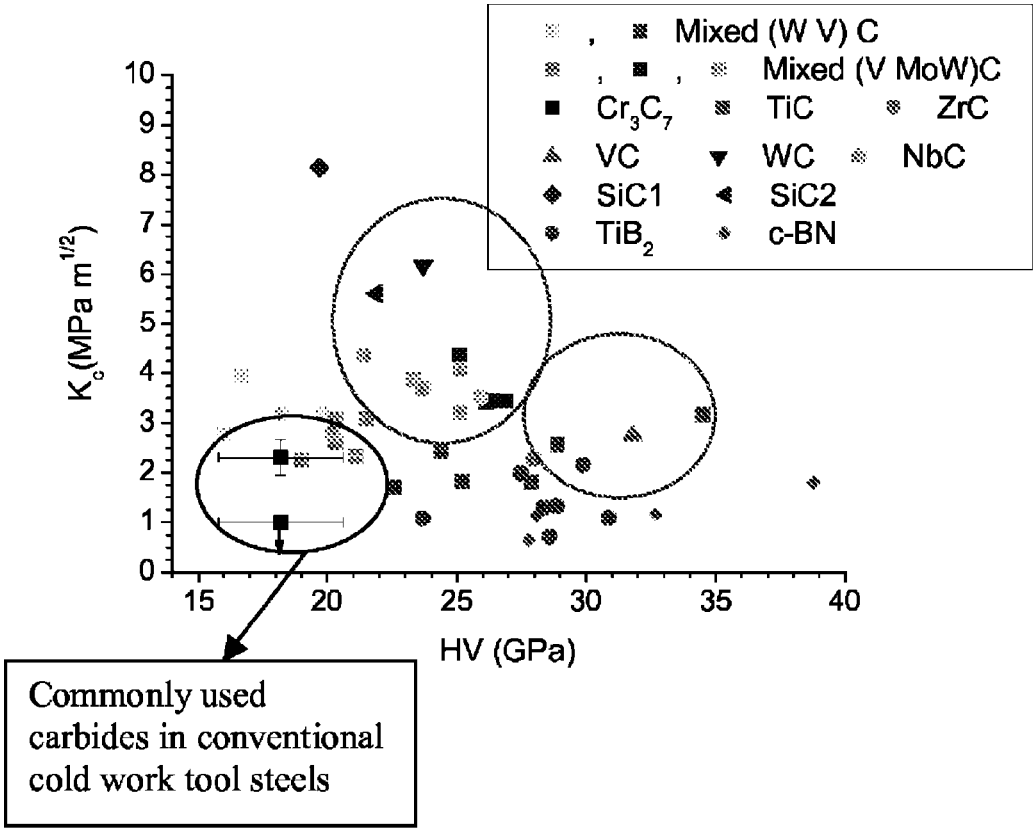
Mixed (W V) C
Mixed (V MoW)C
$Cr_3C_7$
TiC
ZrC
VC
WC
NbC
SiC1
SiC2
$TiB_2$
c-BN
$K_c$(MPa $m^{1/2}$)
HV (GPa)
0
1
2
3
4
5
6
7
8
9
10
15
20
25
30
35
40
Commonly used carbides in conventional cold work tool steels

COLD WORK TOOL STEEL WITH OUTSTANDING WELDABILITY

FIELD OF THE INVENTION

The present invention relates to a cold work martensitic, or at least partly martensitic, tool steel with outstanding weldability and high hardness levels. The steel shows an excellent combination of the most relevant cold work tool steel properties: Hardness—Toughness—Wear resistance.

SUMMARY

Cold work tool steels employed for shaping sheet (cutting, trimming, punching, bending, stamping or drawing), coining, cold bulk stamping, plastic milling knives, hot stamping shearing knives, or even thread milling rolls, etc, often need to be weld. Even before the steel is being put to work, during machining of the tool in annealed state, it already needs to be weld: to correct machining mistakes, design changes to the piece to be obtained or modifications to die geometry in order to overcome spring-back and to be able to obtain the desired piece shape.

Also once the tool has been hardened and put to work, welding occurs quite often: to repair wear, chipping or breakage due to normal usage of the die, or due to an accident. Sometimes this reparation by weld can be done properly by: heating up the tool segment, using as many different cushion layers as needed and making a post-weld heat treatment (normally consisting on a whole tempering cycle) to the die after welding has been completed. Some other times, time to perform the reparation is scarce and welding with one unique electrode without heating of the piece and without post-weld heat treatment is desirable.

There are several techniques to repair trough welding: electric arc welding (refurbished electrode, TIG, MIG, MAG), laser, plasma, electron beam . . . . They differ in the energy concentration and thus the size of the base material melted zone and HAZ (Heat Affected Zone). The most widely used techniques are refurbished consumable electrode and TIG, where an exogenous material is brought into the melt. Thousands of compositions for those "filler materials" have been developed, for different applications and base materials (the material of the tool).

The capability of a material to be weld depends on several factors, which can be grouped in the following categories: physical, metallurgical and mechanical. The main goal of the present invention is to provide a cold work tool steel family with high capability of being weld.

A material can be considered to have a higher capacity of being welded when the following occur:

Accepts a broader range of filler materials to be employed without cracking;

It doesn't crack when less than optimal conditions are being used: no heating of the piece, no hammering of the bed, no stress relieving or tempering after process;

Mechanical properties of the weld are improved in all layers: melt filler material, melt diffusion zone, melt base material and HAZ.

Amongst composition elements some severely affect physical weldability and are thus to be avoided if good weldability is desired, which is the case. Special mention can be given to most machinability enhancers, being sulphur the most commonly used.

One of the elements with strongest impact on mechanical and metallurgical weldability is Carbon (and by extension any other interstitial element employed such as Nitrogen or Boron). So a tool steel with a low level of C+N+B is desired.

For cold work applications, requirements are high, so good compromise of toughness and wear resistance are desired at high hardness: for most applications a hardness in excess of 58 HRc with good wear resistance is required. A cheap way to get high hardness and wear resistance is through carbides, but the presence of carbides implies high carbon contents and therefore comparatively poor weldability. Carbides can be replaced by nitrides or borides but their negative effect on weldability is not much weaker than that of carbon.

One of the most widely used cold work tool steels is AISI D2 (W.Nr. 1.2379), a ledeburitic chromium rich steel with 1.55% C. For comparative purposes, and to provide a meaning to the comparative terms used later in this text (such as good, poor . . . ) we can consider this steel to be the standard and thus to have average toughness, and average wear resistance at the normal usage hardness level (56-62 HRc). The weldability of this standard steel is considered very poor since this is the property which has been more drastically improved with the steels of the present invention.

To attain the hardness levels required, without using interstitial elements like carbon, nitrogen or boron, other strengthening alternatives should be employed like substitutional solid solution, grain refinement and particle strengthening (but instead of secondary carbides, intermetallic coherent precipitates can be used).

Such a solution was developed more than fifty years ago, the so called "maraging" steels have carbon and other interstitial elements as impurity elements and their content is held as low as possible at ppm values. They get their strengthening from substitutional solid solution of primarily Co, and precipitate strengthening with principally: $Ni_3Ti$, $Ni_3Mo$, and $Ni_3Al$ as intermetallic precipitates. Some grades can reach up to 62 HRc after appropriate precipitation heat treatment. Their weldability is excellent, but their wear resistance is poor for most cold work applications. Sometimes this lack of wear resistance can be overcome with a hard coating, but the support they provide for the coating is poor and after coating weldability is often impaired. The poor wear resistance, when compared to a conventional cold work tool steel, is directly related to the absence of very hard secondary phase particles such as carbides, borides or nitrides. This very same reason is the cause of the poorer performance even when a coating is employed.

For the tool steels of the present invention, besides C, N and B as interstitial solid solution elements (they will also be used as carbide formers), some other typical substitutional solid solution elements can be employed, most of them will be present anyway since they are used as carbide formers like can be the case for V, Mo, W, V, and to a lower extent stronger carbide formers with a lower solubility product even with low percentage of C, N and/or B. Other substitutional solid solution elements which are not carbide formers can be used to strengthen the alloy, like Cu (up to a 4%) and Co (up to a 8%). Co will often also be used as a precipitation promoter for the precipitation of Ni intermetallics. The convenience of the presence of these elements is application specific, so different alloys of the present invention will have different quantities of these solid solution strengthening elements, being their presence of all of them obviously not mandatory, so some of the alloys of the present invention might only have C as interstitial solid solution element and V and Cr as substitutional solid solution elements.

As has already been explained, the carbon content could be partially or fully replaced with nitrogen or boron, since the effect is similar for carbides, borides and nitrides on the most relevant properties of interest in the present specification, namely weldability, wear resistance, toughness and hardness. For this reason we will employ a Carbon equivalent (Ceq) concept, where in this case: % Ceq=% C+0.86*% N+1.2*% B.

Most cold work tool steels, excluding shock resistant ones, have Ceq>1%, especially if hardness above 58-60 HRc is required. This is always the case for cold work tool steels with average or above wear resistance. Generally speaking to obtain more than 60 HRc with secondary hardness and good wear resistance, more than 1% Ceq is required, to obtain more than 65 HRc more than 2% Ceq is required and levels of 3% Ceq can bring secondary hardness up to 70 HRc. Secondary hardness is required to be able to apply surface treatments (like nitriding, sulfo-nitriding, boriding) and coatings (like PVD, CVD or ion implantation) to the surface of the tool steel. It is also very important for CVD coatings that the newly developed tool steels present a significantly smaller distortion during heat treatment.

It is the objective of the invention to obtain a cold work martensitic, or at least partly martensitic, tool steel with average or above wear resistance (attained through the presence of primary carbides or alternatively nitrides and/or borides), a hardness in excess of 60 HRc and a very good toughness, but with considerably lower carbon contents (so secondary carbide strengthening should be replaced to the biggest possible extent with other strengthening mechanisms like precipitation hardening or even solid solution), for example 0.5% Ceq to obtain 62 HRc (in the state of the art at least 1% Ceq is required, in JP 01 159353 where compositional ranges are similar 0.9-1% C are needed to obtain 55 and 58 HRc respectively, in U.S. Pat. No. 2,715,576 A where some of the strengthening mechanisms used in the present invention are used 1% C is needed to obtain 48 HRc), or 0.9% Ceq to obtain 67 HRc (in the state of technology more than 1.5% or even 2% Ceq is required). The authors have now found that the solution of this problem is provided by a cold work tool steel having the following composition, all percentages being in weight percent:

| | | | |
|---|---|---|---|
| % Ceq = 0.25-2.5 | % C = 0.25-2.5 | % N = 0-2 | % B = 0-2 |
| % Cr = 0.1-10 | % Ni = 3-12 | % Si = 0.01-2 | % Mn = 0.08-3 |
| % Al = 0.5-5 | % Mo = 0-10 | % W = 0-15 | % Ti = 0-3 |
| % Ta = 0-2 | % Zr = 0-2 | % Hf = 0-2, | % V = 0-12 |
| % Nb = 0-2 | % Cu = 0-4 | % Co = 0-8 | % S = 0-1 |
| % Se = 0-1 | % Te = 0-1 | % Bi = 0-1 | % As = 0-1 |
| % Sb = 0-1 | % Ca = 0-1, | | |

the rest consisting of iron and unavoidable impurities, wherein

% Ceq=% C+0.86*% N+1.2*% B, characterized in that

% Cr+% V+% Mo+% W>3 and

% Al+% Mo+% Ti>1.5 with the proviso that
when % Ceq=0.45-2.5, then % V=0.6-12; or
when % Ceq=0.25-0.45, then % V=0.85-4; or
when % Ceq=0.25-0.45, then % Ti+% Hf+% Zr+% Ta=0.1-4.

Proceeding in this way, a much better weldability for a given level of hardness is attained, but without sacrificing all too much wear resistance, or none at all, and generally significantly improving toughness, depending on the values of certain elements in the formulation.

One of the objectives of the present invention is to obtain high hardness with a comparatively to the present state of the art lower carbon content. Therefore to make a tool steel of the present invention, one exact composition in the composition range has to be chosen together with the thermo-mechanical processing to make sure the steel is martensitic or bainitic or at least partially martensitic or bainitic (with some ferrite, perlite or even some retained austenite). It happens often that two steels representing two very different technological advances, and therefore aiming at very different applications, moreover each being absolutely useless for the objective application of the other, can coincide in the compositional range. In most cases the actual composition will never coincide even if the compositional ranges do more or less interfere, in other cases the actual composition could even coincide and the difference would come from the thermo-mechanical treatments applied. Such a case related to the present invention can be found with relation to JP 01 159353 A, where an austenitic non-magnetic tool steel is made for moulding plastic magnets, where the compositional ranges can more or less coincide with the present invention. In this particular case the actual composition can never coincide since a much higher content of an austenite stabilizer, usually Chromium (Cr), needs to be used to have an austenitic steel, which would be a disaster for the present invention. The steels of the present invention are all magnetic and thus totally useless for the aimed objective of JP 01 159353 A, in the same manner an austenitic tool steel is about the most undesirable for the present invention.

BRIEF DESCRIPTION OF THE DRAWING

FIG. 1 is a plot of hardness against fracture toughness for various carbides and borides.

DETAILED DESCRIPTION OF THE INVENTION

To obtain the desired properties, a combination of primary carbides, substitutional solid solution and intermetallic precipitation strengthening is employed. Other researchers for other applications have previously optimized combinations of some of this strengthening mechanisms; like in AT411905B where secondary carbide strengthening (an undesirable strengthening mechanism for the present invention) is combined with precipitation strengthening for hot work tool steels, and in JP1104749 or the well known Daido Steel Limited NAK55 and NAK80 where all strengthening mechanisms with the exception of primary carbides, are combined for plastic injection mould steels. The same strengthening mechanisms intended for casting or warm forging can be found in U.S. Pat. No. 2,715,576. In those cases the wear resistance of the steels obtained is poor due to the practical absence of primary carbides. No such combination of all three strengthening mechanisms has been used to provide tool steels appropriate for cold work applications, and no other combination of strengthening mechanisms has been reported to offer such outstanding combination of the desired properties: hardness, wear resistance and toughness with outstanding weldability.

Given that the presence of primary carbides is required to supply wear resistance, but we want to benefit from the increase in toughness that a precipitation strengthened matrix can bring, and we want to keep % Ceq as low as possible to increase weld ability, we want to use the carbon present well, and thus make sure that the primary carbides formed are those with best compromise of hardness and toughness. After evaluating with nano-indentation techniques the hardness and fracture toughness of primary carbides (see FIG. 1) it has been found that Vanadium rich MC type carbides, modified with refractory metal additions, present the best compromise of hardness and fracture toughness for several applications (red circle in FIG. 1), so often those will be the primary carbides selected. In some applications fracture toughness of the matrix is more important than that of the primary carbides, and on those cases carbides with stronger carbide former metals will be selected to leave a tougher matrix, and harder carbides, in this case Ti carbides or Ti mixed carbides (primarily with V, W and/or Mo) will be the preferred ones, alternatively Zr and Hf mixed carbides can be used. It is also beneficial to have as little as possible secondary carbides in the matrix, given that precipitates provide a better compromise between hardness and toughness and do not increase % Ceq, so strong carbide formers will be preferred to weaker ones.

When the steel of the present invention is to be used in as cast state, that means no forging, extrusion or rolling is to be applied to the steel, just heat treatments, then the presence of primary carbides has to be very well controlled. This is the situation when the tool steel of the present invention is used to obtain a piece, die or any other kind of tool trough casting of the alloy and pouring it into a recipient with the desired shape, it is also the case when powder of the alloy is used to produce a desired shape trough localized sintering or even melting. This situation is also typical when the alloy of the present invention is used as welding material (either powder for laser, plasma . . . welding or as wire, rod or refurbished electrode for arc welding). Summarizing, this is the case whenever the alloy of the present invention is melt totally or partially and no forging, rolling or extrusion is applied afterwards (in previous paragraphs the desired amount and type of primary carbides are described for the case when forging, extrusion or rolling are applied). In this case when toughness needs to be high less primary carbides should be used and it is very interesting when the primary carbides do not tend to precipitate on grain boundaries. For this objective often a Ti—V mixed carbide will be used. Total amount of primary carbides used will be somewhat lower and thus also Ceq. Using the alloy of the present invention a cast or weld with toughness above 30 J can be obtained (that is 50% more than that of conventional cold work tool steels used today) with a wear resistance more than four times higher and a hardness level of 60 HRc. Due to the high toughness long welding can be performed without cracking of the cord. Welding electrodes used today that deliver a hardness over 58 HRc present a very poor toughness, less than 10 J.

When it comes to intermetallic precipitates several could be used, to mention the most well known: $Ni_3Ti$, $Ni_3Mo$, $Ni_3Al$, NiTi, NiMo and NiAl. To have the high nickel content precipitates quite high amounts of this element are required, and Ni is a quite expensive element. As per the usage of Ti, Al or Mo as element accompanying Ni to form the precipitate it should be noticed that Ti is preferred for the mechanical characteristics that it confers the alloy, but Al is preferred for simplicity since it does not readily form carbides. The problem is the presence of carbon, or other interstitial elements to form wear resistance primary carbides, nitrides or borides. Carbon reacts with Ti quite strongly and forms titanium carbide instead of letting Ti form an intermetallic precipitate with nickel; to avoid this, carbon has to be fixed by stronger carbide formers than Ti. The same can be said about Mo but being a weaker carbide former we have more elements to fix carbon than was the case for Ti, and among them a relatively cheap element like Vanadium. We present below the carbide formers, ordered in increasing strength, so that it is clear which elements can be used to fix carbon if either Ti or Mo are wanted to combine with Ni:

Cr, W, Mo, V, Ti, Nb, Ta, Zr, Hf.

With this strengthening strategy, very good hardness vs. toughness compromises can be attained. Given the lower amount of secondary carbides present, the matrix has a better hardness to toughness ratio. Titanium can be left as a primary carbide former, specially together with vanadium, then other elements, primarily Mo and Al have to be employed for precipitation hardening of the matrix. Using Ti and other strong carbide formers reduces the presence of secondary carbides, which is an less desirable strengthening mechanism of the matrix for the tool steel of the present invention, since precipitation hardening is more desirable.

Therefore the alloy of the present invention will always have some carbide formers of the group: Cr, V, Mo and W. In fact, as can be seen in FIG. 1, normally Vanadium rich mixed carbides (with Cr, Mo, W) are preferably employed. Thus Vanadium will always be present in the tool steels of the present invention, except for a very special high hardness embodiment for applications where high weldability is desired together with extreme toughness and where wear resistance can be sacrificed to enhance toughness. In this case, as can also be seen in FIG. 1, Mo/W primary carbides will be employed instead of Vanadium, and since their fracture toughness is very strongly dependant on the presence of impurities, low levels of Cr and V will be employed, even levels as low as possible of those two elements (they will be present only as unavoidable impurities). Hence, preferred embodiments of the invention for the above applications are steels with the following features:

when % Ceq=0.45-2.5 and % Cr>=2.5, then % V=0.6-12;

when % Ceq=0.45-2.5 and % Cr<2.5, then % Mo+½% W=1.5-17.

When looking at the precipitation strengthening, the tool steel of the present invention will always have enough nickel, and formers of Ni intermetallics like Al, Mo and/or Ti.

For the very low carbon embodiments of the present invention, the exceptional weldability with high hardness levels can be attained following two different strategies when attaining the carbides, depending on the application. For applications where the price of the tool steel is of importance, and for applications where wear resistance is more important than toughness, carbides are primarily formed with Vanadium; for the applications where toughness is of more importance, besides the weldability, strong carbide formers like Ti, Hf, Zr and/or Ta will be employed. Hence, additional preferred embodiments of the invention for the above applications are steels with the following features:

when % Ceq=0.25-0.44, then % V=0.85-4; or when % Ceq=0.25-0.44, then % Ti+% Hf+% Zr+% Ta=0.1-4.

A special case is that of Nb, although its effect on toughness for the tool steels of the present invention is quite negative and thus its presence will be as unavoidable impurity, for some specific applications where grain growth control is desirable, it can be used, in the framework of the present invention up to a 2%.

The addition of machinability enhancers is also feasible in the present invention, to lower the tooling construction costs. The most commonly used element is Sulphur (S), with concentrations below 1%, normally also the content of Mn is increased to make sure Sulphur is present as manganese sulphide and not as iron sulphide which seriously hampers toughness. Also As, Sb, Bi Te, and even Ca can be used for this purpose.

For a given composition the hardness, toughness and wear resistance values of the tool steel and to a lesser extent the weld ability can be strongly affected trough heat treatment as can be observed in Table 3. Different heat treatments for different applications can be used with the tool steels of the present invention.

The tool steel of the present invention can be produced by any metallurgical route, being the most common: sand casting, fine casting, continuous casting, electric furnace melting, vacuum induction melting. Also powder metallurgy ways can be used including any kind of atomization and posterior compactation method like HIP, CIP, cold or hot pressing, sintering, thermal spraying or cladding to mention some. The alloy can be obtained directly with desired shape or further metallurgically improved. Any refining metallurgical processes might be applied like ESR, AOD, VAR . . . forging or rolling can also be employed to improve toughness. The tool steel of the present invention can be obtained as a rod, wire or powder to be employed as welding alloy during welding. Even a die can be constructed by using a low cost casting alloy and supplying the steel of the present invention on the critical parts of the die by welding with a rod or wire made of a steel of the present invention or even laser, plasma or electron beam welded using powder made of the steel of the present invention. Also the tool steel of the present invention could be used with any thermal projection technique to supply it to parts of the surface of another material.

The steel of the present invention can also be used for the construction of structural parts like shafts, gears, connecting rods, bearings and also in sheet format for the construction of resistant structures like are the frames in automobiles, like are the pillars, reinforcements, sail-boards . . . .

EXAMPLES

Some examples are provided of how the steel composition of the invention can be more precisely specified for different typical cold working applications:

Example 1

For most applications, where mechanical requirements are low and could be reached with a conventional cold work tool steel, and thus the gain with the tool steel of the invention is solely the improved weldability, composition should be chosen to minimize price while attaining the optimized weldability. Cheap carbide formers will be used, and intermetallic precipitates will be mainly formed with Al and Mo. Composition should lie in the following range:

| | | | |
|---|---|---|---|
| Ceq: 0.45-0.55 | Cr: 2.0-5.0 | V: 1.0-3.5 | Ni: 3.0-6.0 |
| Si: 0.05-1.5 | Mn: 0.08-2 | Al: 0.5-2.0 | Mo: 0-3 |
| W: 0-2 | Cu: 0-4 | | |

All values are in weight percent.

Example 2

Cutting, punching or trimming applications with very high toughness requirements (due to very high strength of sheet, great thickness of blank or complex geometry). In this case very low levels of carbon are desirable since toughness should be high after reparation. Toughness of the steel is also very important, and price not so detrimental. The precipitation hardening has to represent a bigger proportion of the total, and strong carbide formers, even when expensive ought to be employed. Primary carbides should be rather small, so Cr, Mo and W should not be the preferred alloying elements. Compositions should lie in the following values:

| | | | |
|---|---|---|---|
| Ceq: 0.45-0.6 | Cr: 2-8 | V: 1-3.5 | Ni: 6-12 |
| Si: 0.01-1.4 | Mn: 0.2-3 | Al: 1.5-4 | Mo: 1-3 |
| W: 0.5-2 | Ti: 0.2-2 | Co: 1-6 | Cu: 0-2 |
| and Hf + Zr + Ta + Nb: 0-1. | | | |

Example 3

If even more weld ability is desired or toughness needs to be even higher and some wear resistance can be sacrificed, a version with even lower % Ceq will be employed, in this case one of the very strong carbide formers like Ti, Zr or Hf have to be employed, else most of the carbon will go into the formation of less desirable secondary carbides. Ti, Zr and Hf promote the formation of primary carbides, Ti is specially desirable because it combines very well with V to form mixed primary carbides of very high hardness and acceptable toughness. This composition range with a bit lower primary carbide content, is also very interesting when alloy is to be used as cast, without forging, just with heat treatment. This happens both in model or modeless bulk casting, and also in welding where the steel composition of this application example is used as welding material (as powder for laser, plasma . . . welding, or as wire, rod or refurbished electrode for arc welding):

| | | | |
|---|---|---|---|
| Ceq: 0.25-0.43 | Cr: 0.1-8 | V: 0.9-2 | Ni: 4-12 |
| Si: 0.01-1 | Mn: 0.08-3 | Al: 1.5-3 | Mo: 1-10 |
| W: 0-15 | Ti: 0-3 | Hf: 0-2 | Zr: 0-2 |
| Co: 0-10 | Cu: 0-4 | | |
| and Ti + Zr + Hf: 0.2-2 | | | |

Example 4

For very demanding applications, a preferred way of alloying would be through the usage of ZrC, HfC or (Ti—V)C as carbides and NiTi and as much $Ni_3Ti$ as possible as precipitates. So the final composition should lie in the following ranges:

| | | | |
|---|---|---|---|
| Ceq: 0.45-0.8 | Cr: 0.1-4 | V: 0.6-2 | Ni: 6-12 |
| Si: 0.01-1 | Mn: 0.08-3 | Al: 1.5-5 | Mo: 1-5 |
| W: 0-1 | Ti: 0.5-3 | Hf, Zr: 0.2-2 | Ta, Nb: 0-1 |
| Co: 1.5-14 | Cu: 0-2 | | |

Example 5

For applications where wear resistance has to be very high, high wear resistance particles should be used, like VC, maybe even borides like WB or $TiB_2$. The level of % C will be bigger in this case, and thus weldability lower:

| | | | |
|---|---|---|---|
| Ceq: 0.8-2.5 | Cr: 2-8 | V: 2-12 | Ni: 5-8 |
| Si: 0.05-1 | Mn: 0.08-3 | Al: 1.5-3 | Mo: 1-10 |
| W: 1-15 | Ti: 0.3-3 | Hf: 0-2 | Zr: 0-2 |
| Co: 0-14 | Cu: 0-4 | | |

Example 6

If the tool steel of the present invention is to be employed as a welding alloy, then it has to be made sure that the composition does not lead to segregation or boundary primary carbide precipitation in "as cast" state in order to have decent levels of toughness:

| | | | |
|---|---|---|---|
| Ceq: 0.45-1.2 | | | |
| Cr: 1-8 | V: 0.6-4 | Ni: 4-10 | Si: 0.05-1.5 |
| Mn: 0.08-3 | Al: 1-3 | Mo: 0.3-5 | W: 0-5 |
| Ti: 0-3 | Hf: 0-2 | Zr: 0-2 | Co: 0-8 |
| Cu: 0-4. | | | |

Further Examples of Steels Produced According to the Present Invention:

Several heats have been produced and properties compared to conventional cold work tool steels. In table I the compositions of some of the most relevant heats appear, also the metallurgical way to obtain the heats is specified. In table II the most relevant properties for cold work applications are compared. One can see that with the tool steels of the invention not only the same hardness is obtained with considerably less % Ceq, with the consequent implications for weldability, but also the ratio hardness/toughness is considerably improved.

| Heat | Prd | % Ceq | % Si | % Mn | % Ni | % Co | % Al | % Mo | % V | % W | % Ti | % Zr | % Hf | % Cr |
|---|---|---|---|---|---|---|---|---|---|---|---|---|---|---|
| COLD WORK TOOL STEELS ACCORDING TO THE INVENTION | | | | | | | | | | | | | | |
| CTS-0 | C | 0.52 | 0.82 | 0.14 | 5.7 | 0.3 | 2.08 | 1.4 | 1.74 | 0.78 | 0.5 | 0.28 | <0.01 | 3.52 |
| CTS-1 | C | 0.49 | 1.12 | 0.35 | 5.9 | <0.01 | 2.3 | 1.79 | 2.0 | <0.01 | 2.0 | <0.01 | <0.01 | 3.66 |
| CTS-2 | C | 0.8 | 1.14 | 0.29 | 5.37 | 3.48 | 2.17 | 2.64 | 1.77 | 2.08 | 0.6 | <0.01 | <0.01 | 5.65 |
| CTS-3 | C | 0.56 | 0.1 | 0.15 | 8.32 | 7.35 | 2.21 | 1.8 | 1.31 | 2.7 | 2.1 | 0.54 | <0.01 | 2.44 |
| CTS-4 | C | 0.48 | 0.25 | 0.08 | 11.94 | 9.74 | 4.5 | 3.05 | 1.61 | 3.42 | 1.2 | <0.01 | <0.01 | 1.49 |
| CTS-5 | C | 1.0 | 0.01 | 0.16 | 5.91 | 7.05 | 1.38 | 2.44 | 3.21 | 7.16 | 1.9 | <0.01 | <0.01 | 3.24 |
| CTS-6 | C | 0.51 | 0.03 | 0.16 | 7.93 | 1.75 | 2.1 | 2.85 | 2.85 | <0.01 | 0.8 | 0.53 | <0.01 | 0.15 |
| CTS-7 | C | 0.45 | 0.24 | 1.89 | 7.42 | 1.79 | 2.15 | 2.2 | 2.5 | <0.01 | 0.5 | <0.01 | <0.01 | 1.8 |
| CTS-8 | C | 0.36 | 1.0 | 0.4 | 5.0 | 1.5 | 0.8 | 1.0 | 0.85 | <0.01 | 0.1 | <0.01 | <0.01 | 5.0 |
| CT-0 | P | 0.5 | 1.3 | 0.3 | 6.0 | <0.01 | 2.7 | 1.6 | 1.8 | 0.15 | <0.01 | <0.01 | <0.01 | 3.7 |
| CT-1 | P | 0.49 | 0.01 | 0.3 | 6.5 | <0.01 | 2.6 | 2.6 | 3.2 | 0.31 | 0.33 | 0.24 | <0.01 | 1.3 |
| CT-2 | P | 2.3 | 0.03 | 0.28 | 6.1 | 7.25 | 1.5 | 3.14 | 8.01 | 7.85 | 1.98 | <0.01 | 0.04 | 2.48 |
| FTS-0 | F | 0.54 | 0.12 | 0.38 | 7.2 | 2.18 | 1.86 | 2.03 | 1.51 | 2.13 | 2.06 | 0.02 | 0.02 | 1.96 |
| FTS-1 | F | 0.52 | 0.06 | 0.29 | 5.97 | 1.64 | 1.52 | 1.86 | 2.08 | 0.08 | 1.22 | <0.01 | <0.01 | 2.64 |
| FTS-2 | F | 0.49 | 0.21 | 0.22 | 6.5 | 1.5 | 1.0 | 6.48 | <0.1 | 4.0 | <0.01 | <0.01 | <0.01 | <0.1 |
| FTS-3* | F | 0.30 | 0.1 | 0.4 | 5.0 | 1.5 | 0.8 | 1.0 | 0.95 | <0.01 | <0.01 | <0.01 | <0.01 | 5.0 |
| CONVENTIONAL REFERENCE PRIOR ART COLD WORK TOOL STEELS | | | | | | | | | | | | | | |
| 1.2379 | C | 1.55 | 0.3 | 0.3 | <0.01 | <0.01 | <0.01 | 0.7 | 1.0 | <0.01 | <0.01 | <0.01 | <0.01 | 11.5 |
| 1.2379 | F | 1.55 | 0.3 | 0.3 | <0.01 | <0.01 | <0.01 | 0.7 | 1.0 | <0.01 | <0.01 | <0.01 | <0.01 | 11.5 |
| 1.2379 | P | 1.55 | 0.3 | 0.3 | <0.01 | <0.01 | <0.01 | 0.7 | 1.0 | <0.01 | <0.01 | <0.01 | <0.01 | 11.5 |
| T15 | F | 1.55 | 0.25 | 0.25 | <0.01 | <0.01 | <0.01 | <1 | 5.0 | 12 | <0.01 | <0.01 | <0.01 | 4 |
| T15 | P | 1.55 | 0.25 | 0.25 | <0.01 | <0.01 | <0.01 | <1 | 5.0 | 12 | <0.01 | <0.01 | <0.01 | 4 |
| 1.2367 | F | 0.37 | 0.4 | 0.45 | <0.01 | <0.01 | <0.01 | 3 | 0.55 | <0.01 | <0.01 | <0.01 | <0.01 | 5.0 |

C—Stands for Cast, P—Stands for powder metallurgy (gas atomization + HIP + forging), F— Stands for conventionally melt and forged.
*This heat has also a 0.07% S content.

| Heat | Prd | Hardness [HRc] | Resilience [J] | Fracture Toughness [MPa · √ m] | Wear Resistance [% w.r.t 1.2379 F] |
|---|---|---|---|---|---|
| COLD WORK TOOL STEELS ACCORDING TO THE INVENTION | | | | | |
| CTS-0 | C | 58 | 25 | — | 420 |
| CTS-1 | C | 61 | 32 | 24 | 310 |
| CTS-2 | C | 64 | 41 | 26 | 120 |
| CT-0 | P | 61 | 85 | — | 520 |
| CT-1 | P | 57 | 74 | 28 | 610 |
| CT-2 | P | 69 | 28 | — | 980 |
| FTS-0 | F | 60 | 48 | 29 | 730 |
| CONVENTIONAL REFERENCE PRIOR ART COLD WORK TOOL STEELS | | | | | |
| 1.2379 | C | 57 | 5 | — | 96 |
| 1.2379 | F | 60 | 20 | 25 | 100 |
| 1.2379 | P | 60 | 32 | 22 | 89 |
| T15 | F | 67 | 16 | — | 820 |
| T15 | P | 68 | 25 | 18 | 360 |
| 1.2367* | F | 54 | 250 | 55 | 30 |

C—Stands for Cast, P—Stands for powder metallurgy (gas atomization + HIP + forging), F—Stands for conventionally melt and forged.
*It is normally considered a hot work tool steel, present in the table to be able to compare properties of the tool steels of the invention to prior art tool steel showing secondary hardness but with low % Ceq and thus quite good weld ability.

| Heat | Prd | Heat Treatment | Hardness [HRc] |
|---|---|---|---|
| CTS-0 | C | As weld material, no post treatment | 60 |
| CTS-1 | C | As cast + 520 4 h | 62 |
| CTS-2 | C | As cast + 520 4 h | 64 |
| CTS-3 | C | As cast + 520 4 h | 64 |
| CTS-4 | C | As cast + 520 4 h | 61 |
| CTS-5 | C | As cast | 63 |
| CTS-5 | C | As cast + 540 4 h | 65 |
| CTS-6 | C | As cast + 540 4 h | 59 |
| CTS-7 | C | As cast + 520 4 h | 61 |
| CTS-8 | C | As cast + 520 4 h | 60.5 |
| CTS-0 | C | 1080° C. 30 min Oil cooling + 520 4 h + 540 2 h | 63 |
| CTS-5 | C | 1200° C. 15 min Oil cooling + 520 4 h + 2 × 550 2 h | 68 |
| CT-0 | P | 1080° C. 30 min Oil cooling + 520 2 h + 540 2 h | 61 |
| CT-1 | P | 1060° C. 30 min Oil cooling + 520 2 h + 520 2 h | 57 |
| CT-2 | P | 1200° C. 15 min Oil cooling + 520 4 h + 2 × 550 2 h | 69 |
| FTS-0 | F | 1080° C. 30 min Oil cooling + 520 4 h + 540 2 h | 63 |
| FTS-1 | F | 1080° C. 30 min Oil cooling + 520 4 h + 540 2 h | 61 |
| FTS-2 | F | 1080° C. 30 min Oil cooling + 520 4 h | 62 |
| FTS-3 | F | 1080° C. 30 min Oil cooling + 520 4 h | 61.5 |

C—Stands for Cast, P—Stands for powder metallurgy (gas atomization + HIP + forging), F— Stands for conventionally melt and forged.

Additional embodiments of the invention are disclosed in the dependent claims.

The tool steels of the invention have an extremely good weldability at hardness levels above 60 HRc. The steel presents an excellent combination of the most relevant cold work tool steel properties: Hardness—Toughness—Wear resistance.

The invention claimed is:

1. An at least partly martensitic cold work tool steel having the following composition, all percentages being in weight percent:

| | | | |
|---|---|---|---|
| % Ceq = 0.45-0.55 | % C = 0.25-2.5 | % N = 0-2 | % B = 0-2 |
| % Cr = 1-4 | % Ni = 3-12 | % Si = 0.01-2 | % Mn = 0.08-3 |
| % Al = 1.5-2.5 | % Mo = 0.8-1.5 | % W = 0-15 | % Ti = 0.1-1.2 |
| % Ta = 0-2 | % Zr = 0-2 | % Hf = 0-2 | % V = 0.6-3 |
| % Nb = 0-2 | % Cu = 0-4 | % Co = 0-8 | % S = 0-1 |
| % Se = 0-1 | % Te = 0-1 | % Bi = 0-1 | % As = 0-1 |
| % Sb = 0-1 | % Ca = 0-1 | | |

the rest consisting of iron and unavoidable impurities, wherein

% Ceq=% C+0.86*% N+1.2*% B, characterized in that

% Cr+% V+% Mo+% W>3,

% Al+% Mo+% Ti>1.5, and

% Hf+% Zr+% Ta+% Nb=0-2, with the proviso that when % Ceq=0.45-2.5, then % V=0.6-12; or when % Ceq=0.25-0.45, then % V=0.85-4; or when % Ceq=0.25-0.45, then % Ti+% Hf+% Zr+% Ta=0.1-4 and wherein the steel contains Ni-based intermetallic compounds.

2. An at least partly martensitic cold work tool steel having the following composition, all percentages being in weight percent:

| | | | |
|---|---|---|---|
| % Ceq =1.25-2.5 | % C = 0.25-2.5 | % N = 0-2% | B = 0-2 |
| % Cr = 2-8 | % Ni = 5-8 | % Si = 0.01-2 | % Mn = 0.08-3 |
| % Al = 1.5-3 | % Mo = 2-4 | % W = 0-15 | % Ti = 0.3-3 |
| % Ta = 0-2 | % Zr = 0-2 | % Hf = 0-2, | % V = 3-6 |
| % Nb = 0-2 | % Cu = 0-4 | % Co = 0-7, | % S = 0-1% |
| Se = 0-1 | % Te = 0-1 | % Bi = 0-1 | % As = 0-1 |
| % Sb = 0-1 | % Ca = 0-1, | | |

the rest consisting of iron and unavoidable impurities, wherein

% Ceq=% C+0.86*% N+1.2*% B,

% Cr+% V+% Mo+% W>3%

% Al+% Mo+% Ti>1.5, and

% Hf+% Zr+% Ta+% Nb=0-2, with the proviso that when % Ceq=0.45-2.5, then % V=0.6-12; or when % Ceq=0.25-0.45, then % V=0.85-4; or when % Ceq=0.25-0.45, then % Ti+% Hf+% Zr+% Ta=0.1-4.

3. An at least partly martensitic cold work tool steel having the following composition, all percentages being in weight percent:

| | | | |
|---|---|---|---|
| % Ceq = 0.45-2.5 | % C = 0.25-2.5 | % N = 0-2% | B = 0-2 |
| % Cr = 1-4 | % Ni = 5-12 | % Si = 0.01-1 | % Mn = 0.08-3 |
| % Al = 1.5-5 | % Mo = 1-5 | % W = 0-2 | % Ti = 0.5-3 |
| % Ta = 0-2 | % Zr = 0-2 | % Hf = 0-2, | % V = 0.6-2 |
| % Nb = 0-2 | % Cu = 0-2 | % Co = 1.5-3.2, | % S = 0-1% |
| Se = 0-1 | % Te = 0-1 | % Bi = 0-1 | % As = 0-1 |
| % Sb = 0-1 | % Ca = 0-1, | | |

the rest consisting of iron and unavoidable impurities, wherein

% Ceq=% C+0.86*% N+1.2*% B,

% Cr+% V+% Mo+% W>3%

% Al+% Mo+% Ti>1.5,

% Hf+% Zr+% Ta+% Nb=0-2 and

% Ti+% Hf+% Zr+% Ta+% Nb>0.7, with the proviso that when % Ceq=0.45-2.5, then % V=0.6-12; or when % Ceq=0.25-0.45, then % V=0.85-4; or when % Ceq=0.25-0.45, then % Ti % Hf+% Zr+% Ta=0.1-4.

* * * * *